United States Patent [19]

Fehrer

[11] Patent Number: 4,574,572

[45] Date of Patent: Mar. 11, 1986

[54] APPARATUS FOR MAKING A YARN

[76] Inventor: Ernst Fehrer, Auf der Gugl 28, A-4020 Linz, Austria

[21] Appl. No.: 748,741

[22] Filed: Jun. 25, 1985

[30] Foreign Application Priority Data

Jul. 5, 1984 [AT] Austria ..... 2160/84
Jul. 12, 1984 [AT] Austria ..... 2246/84

[51] Int. Cl.[4] ..... D01H 1/135; D01H 7/885; D01H 5/28; D02G 3/36

[52] U.S. Cl. ..... 57/5; 57/331; 57/334; 57/401; 57/409; 57/410

[58] Field of Search ..... 57/400, 328, 401, 331, 57/408–413, 5, 334, 331

[56] References Cited

U.S. PATENT DOCUMENTS

| | | | |
|---|---|---|---|
| 4,107,909 | 8/1978 | Fehrer et al. | 57/5 |
| 4,112,658 | 9/1978 | Morihashi | 57/328 |
| 4,168,601 | 9/1979 | Didek et al. | 57/401 |
| 4,183,202 | 1/1980 | Morihashi | 57/328 |
| 4,222,222 | 9/1980 | Didek et al. | 57/401 |
| 4,241,571 | 12/1980 | Turk et al. | 57/5 X |
| 4,249,368 | 2/1981 | Fehrer | 57/5 |
| 4,281,507 | 8/1981 | Didek et al. | 57/401 |
| 4,322,944 | 4/1982 | Sraitr et al. | 57/328 |
| 4,327,545 | 5/1982 | Fehrer | 57/5 |
| 4,524,580 | 6/1985 | Fehrer | 57/401 |

FOREIGN PATENT DOCUMENTS

| | | | |
|---|---|---|---|
| 361814 | 8/1980 | Austria | 57/5 |

*Primary Examiner*—John Petrakes
*Attorney, Agent, or Firm*—Kurt Kelman

[57] ABSTRACT

Apparatus for making a yarn comprises a device which succeeds a drawing frame and serves to twist a drawn roving and to wind covering fibers around the drawn roving, and means for supplying the covering fibers. In order to ensure that the covering fibers can be uniformly wound around the roving in a structurally simple apparatus, two spaced apart, coaxial twisting members are provided as well as a ring, which is disposed between and coaxial to the twisting members and serves to supply the covering fibers. Air is sucked from a portion of the periphery of the ring, which can be driven to rotate in the same sense as the twisting members but at a different surface speed. The line of yarn formation extends on the receiving twisting member and the ring to the delivering twisting member along a helix, which has a hand in the sense of rotation of the twisting members.

12 Claims, 7 Drawing Figures

APPARATUS FOR MAKING A YARN

BACKGROUND OF THE INVENTION

1. Field of the Invention

This invention relates to apparatus for making a yarn comprising a device which succeeds a drawing frame and serves to twist a drawn roving and to wind covering fibers around the roving, and means for supplying the covering fibers.

2. Description of the Prior Art

From Austrian Patent Specification No. 361,814 it is known that a drawn roving can be twisted and covering fibers can be wound around said roving in a process in which the drawn roving is pulled through a generally triangular spinning space between two juxtaposed, closely spaced apart spinning drums, which rotate in the same sense, while air is sucked from said triangular space, and in which the roving is supplied with covering fibers in a direction which is transverse to the axis of the roving from a separate drawing frame through that spinning drum which rotates into the triangular spinning space. For this purpose, additional air is sucked from that spinning drum in a corresponding portion of its periphery so that the covering fibers are guided as they move on the surface of the spinning drum into the triangular spinning space and are wound around the partly twisted roving. Whereas the aligning of the covering fibers by means of a drawing frame and the guiding of the covering fibers on the spinning drum which rotates into the triangular spinning space contribute to an effective and uniform winding of the covering fibers around the roving, the result falls short of the expectations. For this reason the covering fibers have been supplied to the triangular spinnign space in a freely flying state although this gives rise to different problems owing to the aerodynamic conditions in the triangular spinning space.

SUMMARY OF THE INVENTION

It is an object of the invention to provide for the making of a yarn a structurally simple apparatus which can be used to twist a drawn roving and to wind covering fibers at a predetermined lead angle around the drawn roving.

In an apparatus of the kind described first hereinbefore, this object is accomplished in accordance with the invention in that the device for twisting a drawn roving and for winding covering fibers around the drawn roving comprises two spaced apart, coaxial twisting members, the supplying means comprise a ring, which is mounted between and coaxial to the twisting members, air is sucked from the ring in a portion of its periphery, which portion constitutes a surface for feeding the covering fibers, said ring is adapted to be driven to rotate in the same sense as the twisting members and at a surface speed differing from that of the twisting members, and the yarn is formed on the surface of the twisting members and of the ring at least substantially along a helical line which extends on the receiving twisting member and the ring to the delivering twisting member and has a hand in the sense in which the twisting members are rotated.

In order to ensure an effective twisting of the drawn roving, the roving must snugly contact at least one twisting member regardless of thickness variations. Contrary to the known guiding of the roving in a triangular spinning space between two spinning drums rotating in the same sense, this is accomplished in accordance with the invention in that the drawn roving is pulled over the surface of the twisting members along a helix rather than parallel to the axis of the twisting member. Because the yarn is withdrawn from the twisting members at a point which is angularly spaced from the point where the roving is received by the twisting mmembers, the roving contacts the twisting members over an angle of wrap and is thus subjected to tensile stresses resulting in a radial resultant force so that the roving is in pressure contact with the surface of the twisting members and frictional forces are exerted, which act in a peripheral direction of the twisting members and have a component that is at right angles to the axis of the roving and exerts a twisting torque on the roving, and have also a component which is in the direaction of the axis of the roving and exerts a force tending to advance the roving. Because the roving is guided along a helix which has a hand in the sense in which the twisting members are rotated, the roving can be uniformly twisted on the surface of a twisting member even though no air is sucked from that twisting member. As a result, less energy is consumed and the manufacture of the twisting member is greatly facilitated.

In order to hold the fibers of the twisted roving together, covering fibers are wound around the twisted roving and are supplied via the ring which is disposed between the two twisting members and from which air is sucked. In dependence on the lead angle of the line of yarn formation, said covering fibers are tied into the partly twisted roving and are wound around the roving at a certain angle to the axis of the roving. The winding of the covering fibers around the roving is initiated in the region in which the covering fibers are supplied and is completed adjacent to the twisting member from which the yarn is withdrawn.

A uniform winding of the covering fibers around the drawn roving cannot be achieved unless the covering fibers are supplied to the roving at a velocity which is adapted to the velocity at which the covering fibers are processed. Because a slip between the twisting members and the twisted roving is inevitable, the surface velocity of the twisting members is much higher than the surface velocity of the twisted roving and the covering fibers could not be uniformly tied into the partly twisted roving if the covering fibers were supplied at a velocity which is equal to the surface velocity of the twisting members. For this reason the ring is driven to rotate at a surface speed which differs from the surface speed of the twisting members and which is adapted to the velocity at which the covering fibers are processed. That surface speed of the ring depends on the surface speed of the roving as it is twister and on the velocity at which the yarn is withdrawn. The less strongly the individual covering fibers are held together, the larger will be the tolerance for the surface speed of the ring.

To ensure that the course of the roving and the angle at which the covering fibers are wound around the roving in the region in which the covering fibers are tied into the roving will not depend on the instantaneous force relations in that region, means for guiding the roving may be provided between the ring serving to supply the covering fibers and the receiving twisting member. Such guiding means will prevent a deviation of the roving from its prescribed course and will ensure that the covering fibers will be wound at an angle which is determined by the structure of the apparatus.

A particularly simple structure will be obtained if the guiding means consist of a radially projecting lug provided on a coaxial collar disposed between the receiving twisting member and the ring serving to supply the covering fibers. Whereas the collar is fixed during the spinning operation, it is angularly adjustable to set the angle at which the covering fibers are wound because the radially protruding lug will determine the course of the roving.

To ensure that the drawn roving can be uniformly supplied to the receiving twisting member, that twisting member may be axially preceded by a drivable feeding ring, from which air is sucked in a portion of its periphery and which serves to feed the drawn roving. As a result, the drawn roving is positively guided as it is fed to the receiving twisting member so that disturbing irregularities in the region in which the roving is supplied will be precluded. At the delivering end of the peripheral portion from which air is sucked, the roving will be deflected toward the twisting member so that the point at which the roving is received by the receiving twisting member will be determined by the structure of the apparatus. That receiving point may additionally be determined by a pressure-applying roller, which clamps the roving against the delivery end of that peripheral portion of the feeding ring from which air is sucked.

The ring for feeding the drawn roving may desirably be provided with separate drive means so that the roving can be fed to the succeeding twisting member at a predetermined velocity that has been selected in consideration of the actual conditions.

To determine the line of yarn formation also on the delivery side, the yarn being formed must be properly guided adjacent to the delivering twisting member. Such a guidance might be ensured by an eyelike or forked guiding member or by a withdrawal of the yarn in a predetermined direction. Alternatively, the helical portion of the line of yarn formation may terminate on the delivering twisting member adjacent to a zone from which air is sucked. In that case the suction forces exerted will result in corresponding constraining forces.

The delivering twisting member and an additional twisting member, which is parallel to the delivering twisting member and driven to rotate in the same sense may define a triangular spinning space, and air may be sucked from said spinning space. In that case the winding of the covering fibers around the roving may be initiated along the helical portion of the line of yarn formation and may be completed in the triangular spinning space, the receiving end of which is disposed at the end of the helical portion of the line of yarn formation.

Because it is basically sufficient to force the roving to be twisted against the surface of the twisting members by the exertion of suitable tensile stresses, the twisting members will be able to perform the expected function if they are so shaped that there are no concavely curved surfaces along the helical line of yarn formation so that the roving cannot detach from the surface of the twisting member. That requirement can be met by widely different solids of revolution. A particularly simple structure will be obtained if the twisting members and the ring for supplying the covering fibers are circular cylinders equal in outside diameter.

Whereas it is not necessary to align the covering fibers by means of a drawing frame, it will be desirable to parallelize the covering fibers by means of a drawing frame. In the known apparatus comprising a drawing frame for drawing the roving and a drawing frame for drawing the covering fibers, it would be necessary to arrange the two drawing frames at right angles to each other although this would give rise to difficulties in regarding the design. In accordance with the invention the line of yarn formation extends at a predetermined lead angle rather than parallel to the axis so that the drawing frame for drawing the roving may extend in an at least approximately radial direction, i.e., parallel to the drawing frame for drawing the covering fibers.

DETAILED DESCRIPTION OF THE PREFERRED EMBODIMENTS

Figure 1:
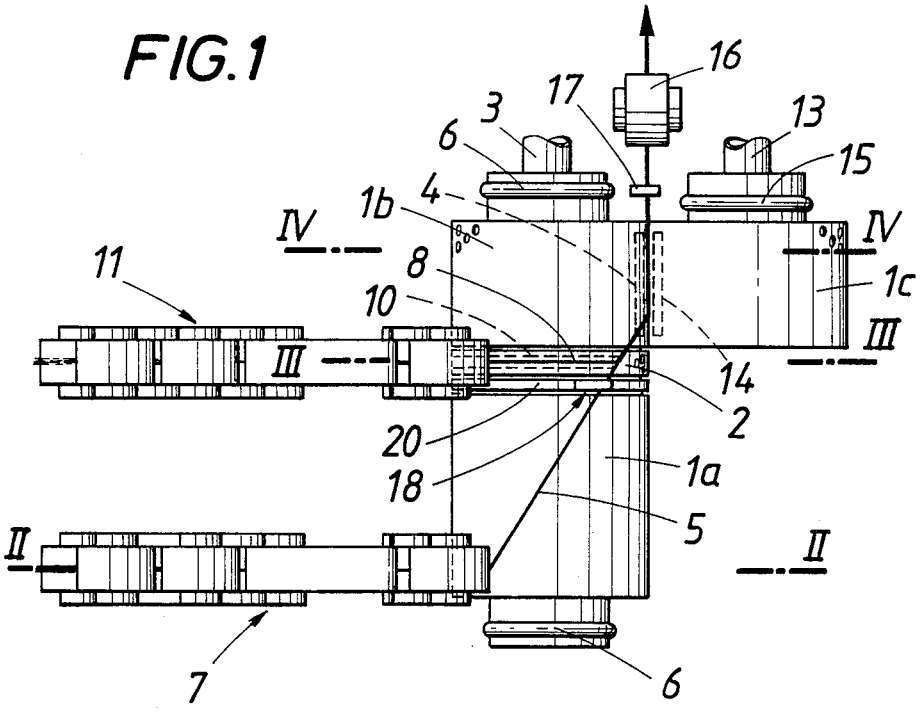
FIG. 1 is a diagrammatic top plan view showing apparatus in accordance with the invention for the making of a yarn.
Figure 2:
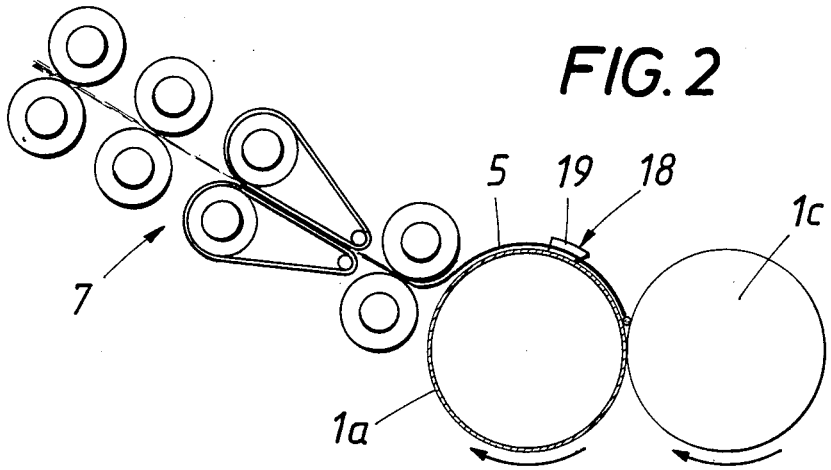
FIG. 2 is a sectional view taken on line II—II in FIG. 1.

The subject matter of the invention is shown by way of example in the drawing.

The illustrated apparatus essentially comprises two coaxial, spaced apart twisting members 1*a*, 1*b* and a ring 2, which is disposed between and coaxial to the twisting members and has an air-permeable shell equal in diameter to the twisting members. No air is sucked from the twisting member 1*a*, which consists of a closed drum. The twisting member 1*b* consists of a sieve drum and is provided with a suction insert 3, which has a suction zone 4 that is angularly spaced from the point where the roving is supplied to the twisting member 1*a*. As a result, the roving 5 extends along a helix on the surfaces of the twisting members 1*a* and 1*b* and of the ring 2. When the two twisting members 1*a*, 1*b* are driven by means of a belt drive 6 to rotate in a sense that corresponds to the hand of that helix, the roving 5 will be subjected by the surfaces of the twisting members 1*a*, 1*b* to a twisting torque and to a force acting along the axis of the roving. As a result, a roving 5 supplied to the twisting member 1*a* by a drawing frame 7 will be twisted along the helical line of yarn formation, which is determined by the fact that the yarn is withdrawn from a point which is angularly spaced apart from the point at which the roving is supplied.

To hold the roving 5 in its partly twisted state adjacent to the twisting member 1*a*, covering fibers 8 are wound around the partly twisted roving 5 and are supplied to the roving via the ring 2. For this purpose the ring 2 is provided with a suction insert 9, which defines a suction slot 10 that extends as far as to the line of yarn formation. As a result, a feeding surface is provided on that portion of the periphery of the ring 2 from which air is sucked and the covering fibers 8 are guided as they move on said surface toward the twisted roving. To ensure that the covering fibers 8 are parallel to each other as they are delivered to the ring 2, the covering fibers 8 are fed via a drawing frame 11. The covering fibers 8 are delivered to the ring 2 substantially in the direction in which the drawn roving 5 is supplied to the twisting member 1*a* so that the drawing frames 7 and 11 may be juxtaposed and parallel to each other.

Figure 3:
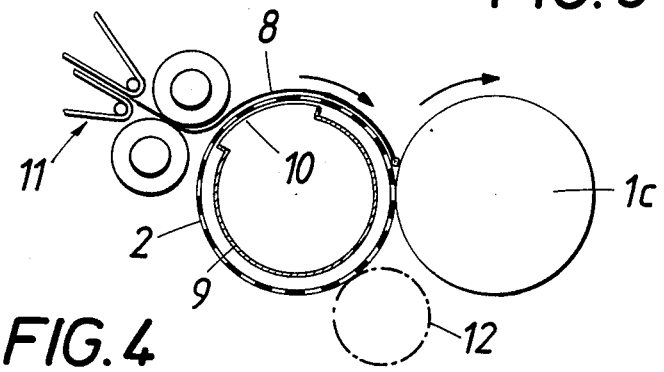
FIG. 3 is a sectional view taken on line III—III in FIG. 1.
Figure 4:
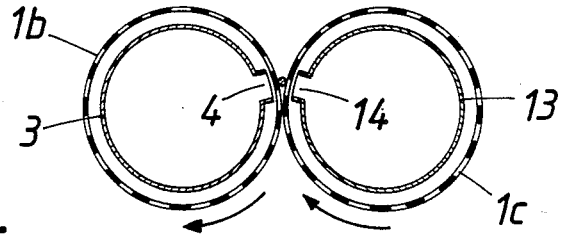
FIG. 4 is a sectional view taken on line IV—IV in FIG. 1.
Figure 5:
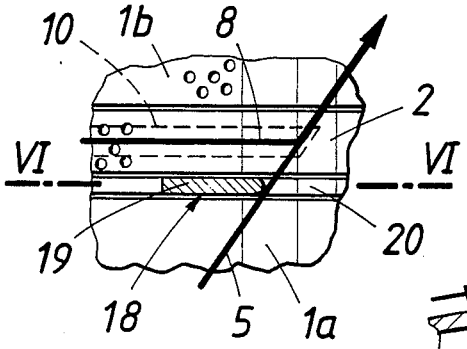
FIG. 5 is a top plan view showing on a larger scale the ring for feeding the covering fibers and the collar for guiding the roving adjacent to the line of yarn formation.
Figure 6:
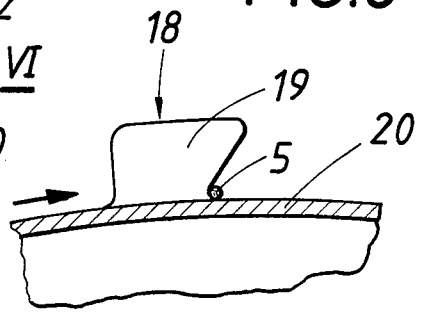
FIG. 6 is a sectional view taken on line VI—VI in FIG. 5.

Because the line of yarn formation is helical, the covering fibers 8 are fed to the twisted roving 5 at a predetermined angle, which depends on the lead angle of the line of yarn formation. This fact facilitates the tying of the covering fibers into the roving and the subsequent winding of the covering fibers around the roving at a predetermined lead angle. But the covering fibers cannot be uniformly wound around the roving unless the covering fibers are delivered at a velocity which is adapted to the velocity at which they are processed. The latter velocity will essentially depend on the surface speed of the roving and on the velocity at which the yarn is withdrawn. For this reason the ring 2 must be driven separately from the twisting members 1*a* and 1*b*. In the embodiment shown by way of example this is effected by means of a friction wheel 12, which is indicated in phantom in FIG. 3.

The winding of the covering fibers around the roving is completed in a triangular spinning space, which is defined by the delivering twisting member 1*b* and an additional twisting member 1*c*, which is axially parallel to the twisting member 1*b*. The twisting member 1*c* has a suction insert 13, which defines a suction zone 14 that faces the triangular spinning space. The twisting member 1*c* can be driven by a belt drive 15 to rotate in the same sense as the twisting member 1*b*. As a result, the covered roving is pulled into the triangular spinning space and is forced against both twisting members 1*b* and 1*c* at the same time. When the yarn has thus been completed, it can be axially withdrawn by means of withdrawing rollers 16 anc dan then be wound on bobbins. The position of the yarn may be additionally determined by means of a yarn guide 17.

In order to ensure that the course of the roving 5 in the region in which the covering fibers are supplied will not depend on the forces acting in that region and to ensure that the covering fibers will be wound around the roving at a predetermined lead angle, guiding means 18 for guiding the roving 5 and for preventing a wandering thereof are provided between the ring 2 and the receiving twisting member 1*a*. In the embodiment shown by way of example said guiding means 18 consist of a radially protruding lug 19, which is provided on a coaxial collar 20, which is angularly adjustable for a selection of a desired lead angle of the covering fibers.

Figure 7:
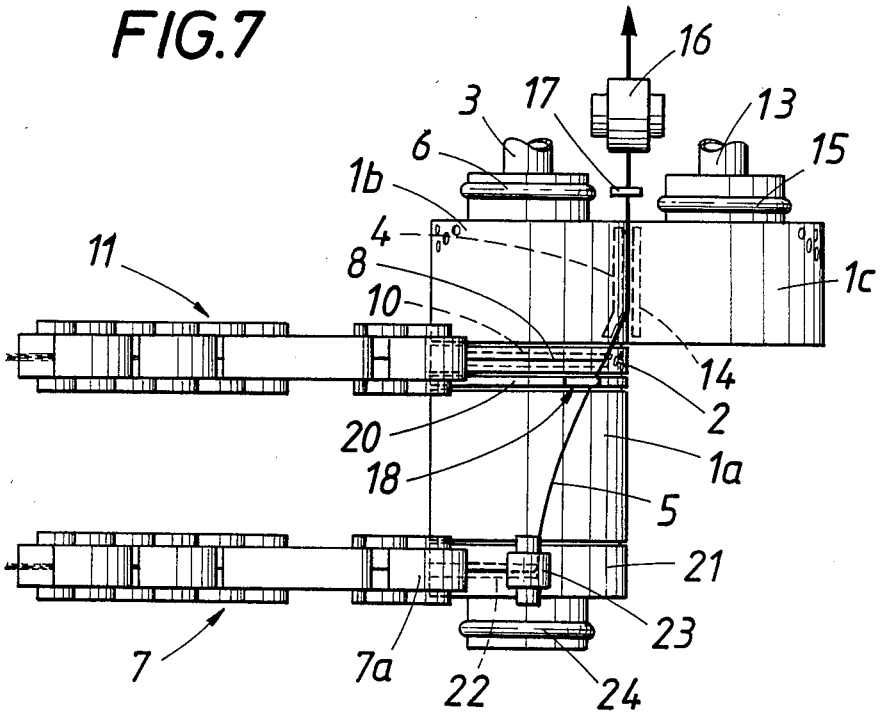
FIG. 7 is a view that is similar to FIG. 1 and shows a modified design.

The embodiment shown in FIG. 7 differs from the design shown in FIGS. 1 to 6 only in that the roving 5 is supplied from the drawing frame 7 via a feeding frame 21, which is coaxial to the twisting member 1*a* and axially precedes the same and comprises a suction insert that defines a suction slot 22, which extends around a part of the periphery of the feeding ring 21. The roving 5 is delivered by the delivering pair of rollers 7*a* of the drawing frame 7, which extends radially to the feeding ring 21, and that roving can be directly taken over by the feeding ring 21 and will be guided as it moves to the twisting member 1*a* along that portion of the periphery of the feeding ring 21 from which air is sucked. The point at which the roving 5 is deflected at the delivery end of the suction slot 10 is defined by a pressure-applying roller 23, which is associated with the feeding ring 21 and provided with a covering of rubberlike elasticity and clamps the roving 5 against the feeding ring 21. The feeding ring 21 is driven by a belt drive 24 so that the drawn roving can be supplied at a velocity which is independent of the operation of the twisting members.

I claim:

1. In apparatus for making a yarn, comprising a drawing frame for supplying a drawn roving, twisting and winding means for twisting said drawn roving and for winding covering fibers around said drawn roving so as to form a yarn, fiber supply means for supplying covering fibers to said twisting and winding means, and means for withdrawing said yarn from said twisting and winding means, the improvement residing in that said twisting and winding means comprise two coaxial, axially spaced apart twisting members consisting of a receiving twisting member for receiving said drawn roving from said drawing frame and a delivering twisting member for delivering said yarn to said withdrawing means, said fiber supply means comprise a fiber supply ring, which is disposed between and coaxial to said twisting members, and means for sucking air from a portion of the periphery of said fiber supply ring to define on said fiber supply ring a fiber feeding surface for feeding said covering fibers to said roving between said twisting members, drive means are provided for driving said twisting members to rotate in a predetermined sense and for driving said supply ring to rotate in the same sense as said twisting members at a different speed, and the arrangement is such that said yarn is formed on said twisting members on a substantially helical line of yarn formation extending on the receiving twisting member and via said supply line to said delivering twisting member and having a hand in said predetermined sense.

2. The improvement set forth in claim 1, wherein said receiving twisting member is arranged to receive said drawn roving from said drawing frame at a predetermined receiving point of the periphery of said receiving twisting member and said withdrawing means are arranged to withdraw said yarn from said delivering twisting member at a predetermined delivering point disposed on the periphery of said delivering twisting member and angularly spaced apart from said receiving point.

3. The improvement set forth in claim 1, wherein means for guiding said roving are provided between said receiving twisting member and said fiber supply ring.

4. The improvement set forth in claim 3, wherein an angularly adjustable collar is disposed between said receiving twisting member and said fiber supply ring and said guiding means comprise a lug, which is carried by and radially protrudes from said collar.

5. The improvement set forth in claim 1, wherein a drivable feeding ring for feeding said drawn roving is provided on that side of said receiving twisting member that is opposite to said fiber supply ring and said feeding ring is arranged to receive said drawn roving from said drawing frame, and means are provided for sucking air from a portion of the periphery of said feeding ring.

6. The improvement set forth in claim 5, wherein said portion of the periphery of said feeding ring has a delivery end, said receiving twisting manner is arranged to receive said drawn roving from said delivery end, and a pressure applying roller is provided, which is adapted to force said drawn roving against said feeding ring at said delivery end.

7. The improvement set forth in claim 5, wherein means which are separate from said drive means for driving said twisting members and said fiber supply ring are provided for driving said feeding ring.

8. The improvement set forth in claim 5, wherein said drawing frame extends approximately radially to said feeding ring.

9. The improvement set forth in claim 8, wherein said twisting members and said fiber supply ring are circular cylinders equal in outside diameter.

10. The improvement set forth in claim 1, wherein a third twisting member is provided, which is axially parallel to said delivering twisting member and defines with the latter a triangular spinning space, means are provided for sucking air from said spinning space, means are provided for driving said third twisting member to rotate in said predetermiend sense, and said withdrawing means are operable to withdraw said yarn from said triangular spinning space.

11. The improvement set forth in claim 1, wherein said twisting members and said fiber supply ring are circular cylinders equal in outside diameter.

12. The improvement set forth in claim 1, wherein said drawing frame extends approximately radially to said receiving twisting member.

* * * * *